US006936965B1

(12) United States Patent
Park

(10) Patent No.: US 6,936,965 B1
(45) Date of Patent: Aug. 30, 2005

(54) PLASMA DISPLAY PANEL

(75) Inventor: Hun Gun Park, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 466 days.

(21) Appl. No.: 09/717,284

(22) Filed: Nov. 22, 2000

(30) Foreign Application Priority Data

Nov. 24, 1999 (KR) ..... P99-52534
Nov. 24, 1999 (KR) ..... P99-52535
Nov. 24, 1999 (KR) ..... P99-52536

(51) Int. Cl.[7] ..... H01J 17/49
(52) U.S. Cl. ..... 313/582; 313/292
(58) Field of Search ..... 313/581–587, 313/292, 238, 495; 345/74.1–76, 55, 60; 315/169.3, 169.4; 445/24, 25

(56) References Cited

U.S. PATENT DOCUMENTS 4,575,751 A * 3/1986 Duschl ..... 348/125
5,674,553 A * 10/1997 Shinoda et al. ..... 427/68
5,777,436 A * 7/1998 Lepselter ..... 313/582
5,939,826 A * 8/1999 Ohsawa et al. ..... 313/582
5,982,082 A * 11/1999 Janning ..... 313/336
6,048,243 A * 4/2000 Kosaka et al. ..... 445/24
6,055,030 A * 4/2000 Izumi ..... 349/73
6,097,151 A * 8/2000 Kim et al. ..... 313/586
6,259,505 B1 * 7/2001 Makino ..... 349/153
6,275,273 B1 * 8/2001 Inoue ..... 349/40
6,337,028 B1 * 1/2002 Masuko et al. ..... 216/4
6,353,288 B1 * 3/2002 Asano et al. ..... 313/582
6,380,678 B1 * 4/2002 Kim ..... 313/586
6,580,216 B1 * 6/2003 Lu et al. ..... 313/582
6,597,113 B1 * 7/2003 Nitta ..... 313/581
6,600,265 B1 * 7/2003 Ebihara et al. ..... 313/586
6,621,231 B1 * 9/2003 Kwon ..... 315/169.3
6,650,051 B1 * 11/2003 Park et al. ..... 313/582

FOREIGN PATENT DOCUMENTS

JP 60-9029 1/1985
JP 5-114362 5/1993
JP 8-293253 11/1996
JP 9-129142 5/1997
JP 9-320475 12/1997
JP 10-269951 10/1998
JP 10-275563 10/1998
JP 11-7897 1/1999
JP 11-25866 1/1999
JP 11-250812 9/1999
JP 11-265661 9/1999

* cited by examiner

*Primary Examiner*—Edward J. Glick
*Assistant Examiner*—Elizabeth Keaney
(74) *Attorney, Agent, or Firm*—Fleshner & Kim, LLP.

(57) ABSTRACT

A plasma display panel that is capable of improving a contrast as well as reducing the power consumption. In the plasma display panel, a distance between the sustaining electrode pair at a display region is different from that at a non-display region. A width of the barrier rib at the display region is different from that at the non-display region. The non-display region is provided with black matrices for shutting off a light.

A protective layer is provided only at the display region.

8 Claims, 12 Drawing Sheets

PLASMA DISPLAY PANEL

BACKGROUND OF THE INVENTION

1. Field of the Invention

This invention relates to a plasma display panel, and more particularly to a plasma display panel that is capable of improving a contrast as well as reducing the power consumption.

2. Description of the Related Art

Recently, a plasma display panel (PDP) feasible to a manufacturing of a large-dimension panel has been highlighted as a flat panel display device. The PDP typically includes a three-electrode, alternating current (AC) surface discharge PDP that has three electrodes and is driven with an AC voltage as shown in FIG. 1.

Referring to FIG. 1, a discharge cell of the three-electrode, AC surface discharge PDP includes a scanning/sustaining electrode 12Y and a common sustaining electrode 12Z formed on an upper substrate 10, and an address electrode 20X formed on a lower substrate 18. The scanning/sustaining electrode 12Y and a common sustaining electrode 12Z are transparent electrodes made from indium thin oxide (ITO). Since the scanning/sustaining electrode 12Y and the common sustaining electrode 12Z have high resistance values, first and second bus electrodes 28Y and 28Z are formed at the rear sides of the scanning/sustaining electrode 12Y and the common sustaining electrode 12Z. The first and second bus electrodes 28Y and 28Z receive a driving waveform from a driving waveform supply (not shown) and apply it to the scanning/sustaining electrodes 12Y and the common sustaining electrode 12Z. On the upper substrate 10 in which the scanning/sustaining electrode 12Y is formed in parallel to the common sustaining electrode 12Z, an upper dielectric layer 14 and a protective film 16 are disposed. Wall charges generated upon plasma discharge are accumulated in the upper dielectric layer 14. The protective film 16 prevents a damage of the upper dielectric layer 14 caused by the sputtering generated during the plasma discharge and improves the emission efficiency of secondary electrons. This protective film 16 is usually made from MgO. A lower dielectric layer 22 and barrier ribs 24 are formed on the lower substrate 18 provided with the address electrode 20X, and a fluorescent material 26 is coated on the surfaces of the lower dielectric layer 22 and the barrier ribs 24. The address electrode 20X is formed in a direction crossing the scanning/sustaining electrode 12Y and the common sustaining electrode 12Z. The barrier ribs 24 is formed in parallel to the address electrode 20X to prevent an ultraviolet ray and a visible light generated by the discharge from being leaked to the adjacent discharge cells. The fluorescent material 26 is excited by an ultraviolet ray generated upon plasma discharge to produce a red, green or blue color visible light ray. An active gas for a gas discharge is injected into a discharge space defined between the upper/lower substrate and the barrier rib.

As shown in FIG. 2, such a discharge cell is arranged in a matrix type. In FIG. 2, the discharge cell 1 is provided at each intersection among scanning/sustaining electrode lines Y1 to Ym, common sustaining electrode lines Z1 to Zm and address electrode lines X1 to Xn. The scanning/sustaining electrode lines Y1 to Ym are sequentially driven while the common sustaining electrode lines Z1 to Zm are commonly driven. The address electrode lines X1 to Xn are driven with being divided into odd-numbered lines and even-numbered lines.

Such a three-electrode, AC surface discharge PDP is driven with being separated into a number of sub-fields. In each sub-field interval, a light emission having a frequency proportional to a weighting value of a video data is conducted to provide a gray scale display. For instance, if a 8-bit video data is used to display a picture of 256 gray scales, then one frame display interval (e.g., 1/60 second=16.7 msec) in each discharge cell 1 is divided into 8 sub-fields SF1 to SF8. Each sub-field is again divided into a reset interval, an address interval and a sustaining interval. A weighting value at a ratio of 1:2:4:8: . . . :128 is given in the sustaining interval. Herein, the reset interval is a period for initializing the discharge cell; the address interval is a period for generating a selective address discharge in accordance with a logical value of a video data; and the sustaining interval is a period for sustaining the discharge in a discharge cell in which the address discharge has been generated. The reset interval and the address interval are equally assigned in each sub-field interval.

As shown in FIG. 3A to FIG. 3C, such a PDP is divided into an effective display part 30 in which a picture is to be displayed and a non-display part 32 in which a picture is not to be displayed. The effective display part 30 has a number of discharge cells 1 arranged in a matrix pattern to display a picture. The non-display part 32 is mounted with various circuits for driving the electrodes 12Y and 12Z within the discharge cell 1 so that the discharge cells 1 in the effective display part 30 can display a picture. The scanning/sustaining electrode 12Y and the common sustaining electrode 12Z are extended from the effective display part 30 into the non-display part 32. In this case, the first and second bus electrodes 28Y and 28Z are extended into a longer distance than the scanning/sustaining electrode 12Y and the common sustaining electrode 12Z to receive a driving waveform from the driving waveform supply. A driving waveform is alternately applied to the first and second bus electrodes 28Y and 28Z in the sustaining interval. By the driving waveform applied to the first and second bus electrodes 28Y and 28Z, a discharge is generated at the effective display part 30 and the non-display part 32. In other words, since the scanning/sustaining electrode 12Y and the common sustaining electrode 12Z are extended into the non-display part 32, an undesired discharge is generated at the non-display part 32. Also, a picture is not displayed at the non-display part 32, the barrier ribs 24 and the fluorescent material 26 are not provided. Thus, the non-display part 32 has a discharge space wider than the effective display part 30 to generate a discharge more easily than the effective display part 30.

The conventional PDP as described above has a problem in that, since an undesired discharge is generated at the non-display part 32, it has large power consumption. Also, it has a problem in that its contrast is deteriorated due to a light produced by the discharge at the non-display part 32. Moreover, the conventional PDP has a problem in that, since an electric field concentrates on the corners 34 of the scanning/sustaining electrode 12Y and the common sustaining electrode 12Z formed at the non-display part 32, an insulation breakage in the transparent electrodes may occur.

SUMMARY OF THE INVENTION

Accordingly, it is an object of the present invention to provide a plasma display panel (PDP) that is capable of improving a contrast as well as reducing power consumption.

In order to achieve these and other objects of the invention, in a plasma display panel according to an embodiment of the present invention, a distance between a sustaining electrode pair at a display region is different from that at the non-display region.

In a plasma display panel according to another embodiment of the present invention, a width of a barrier rib at a display region is different from that at a non-display region.

In a plasma display panel according to still another embodiment of the present invention, a non-display region is provided with black matrices for shutting off a light.

In a plasma display panel according to still another embodiment of the present invention, a protective layer is provided only at a display region.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
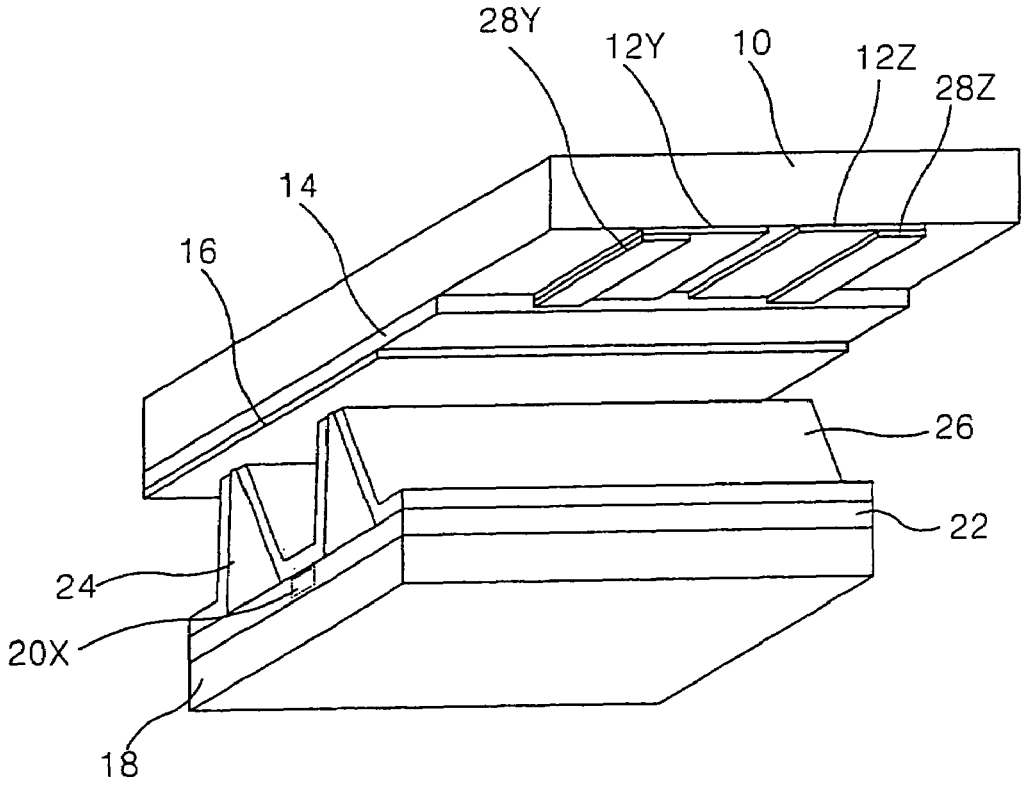
FIG. 1 is a perspective view showing a structure of a discharge cell of a conventional three-electrode, AC surface discharge plasma display panel.
Figure 2:
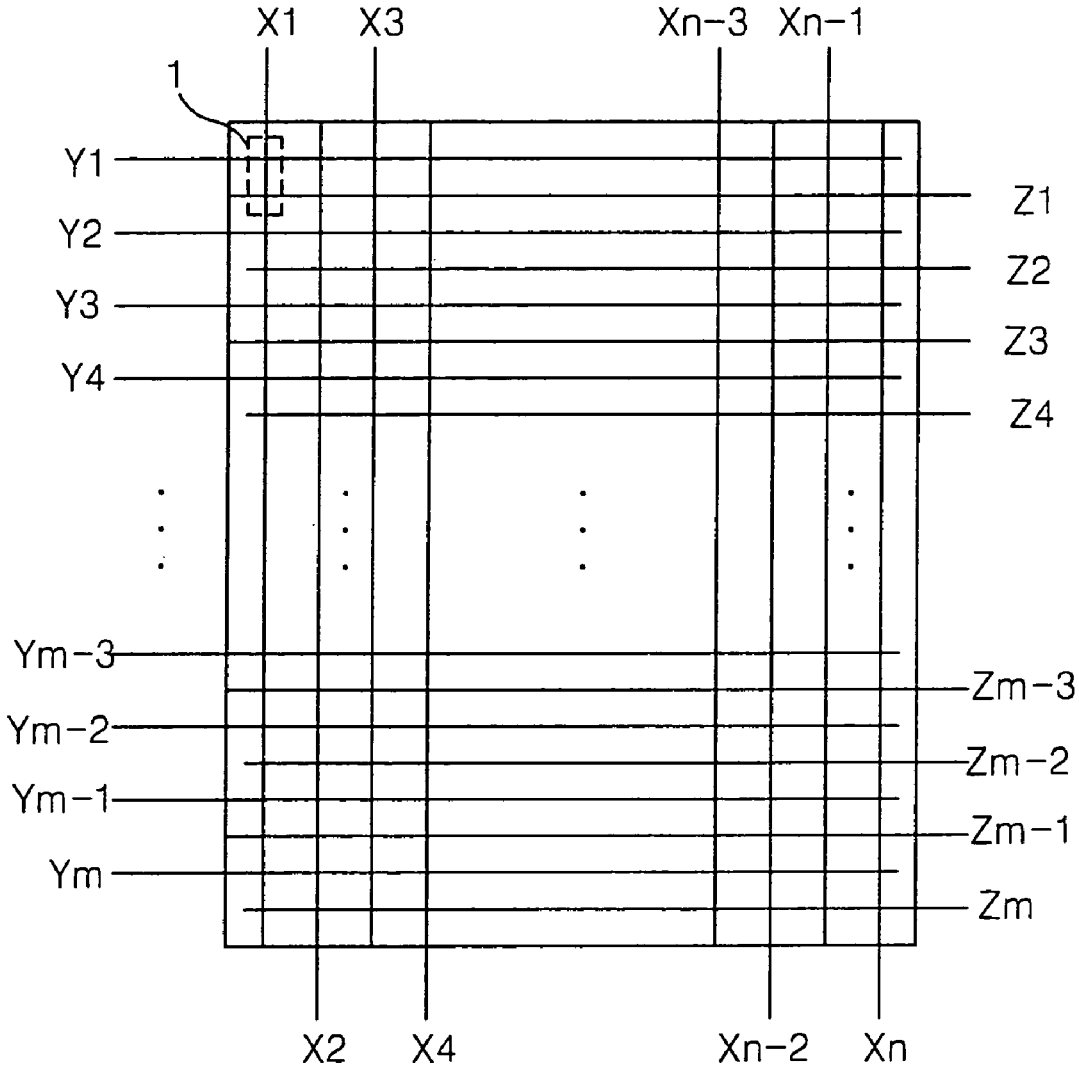
FIG. 2 illustrates an entire electrode arrangement of a plasma display panel including the discharge cells shown in FIG. 1.
Figure 3A:
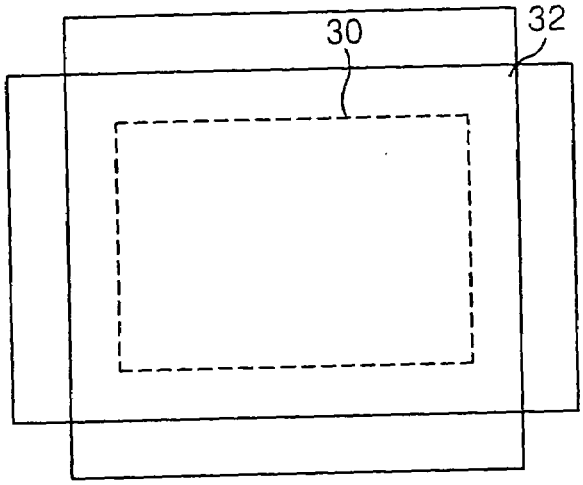
FIG. 3A is a schematic view showing an arrangement of an effective display part and a non-display part in the conventional plasma display panel.
Figure 3B:
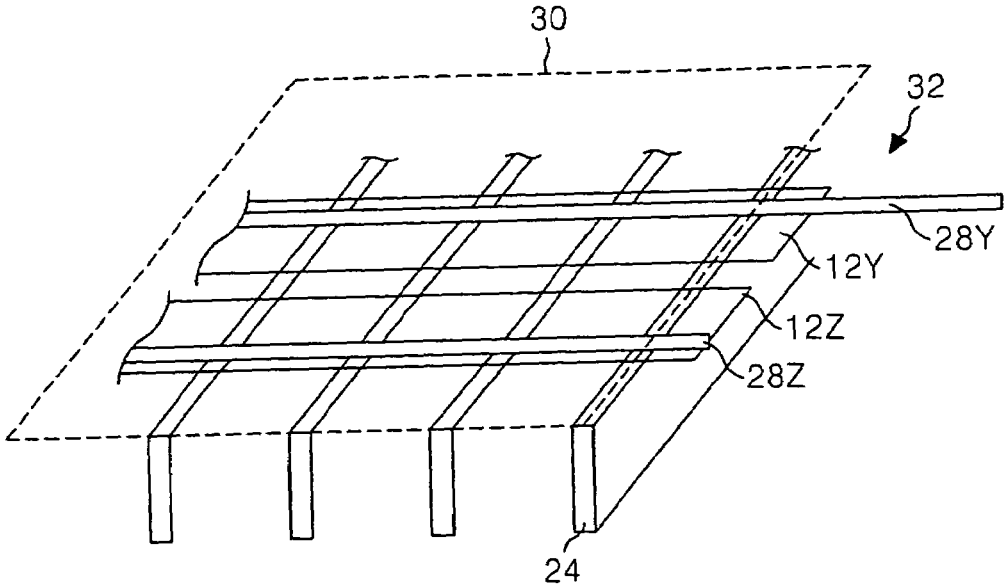
FIG. 3B and FIG. 3C are schematic views showing an arrangement of a scanning/sustaining electrode and a common sustaining electrode provided at the effective display part and the non-display part in FIG. 3A.
Figure 3C:
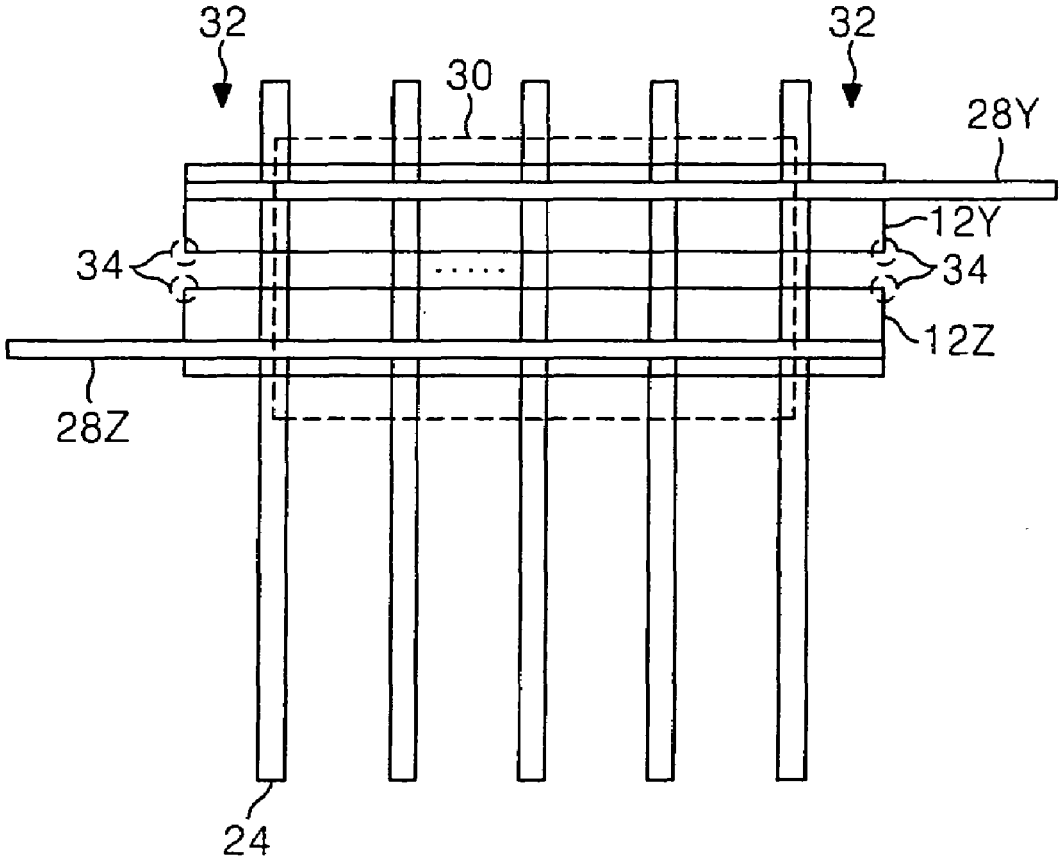
Figure 4:
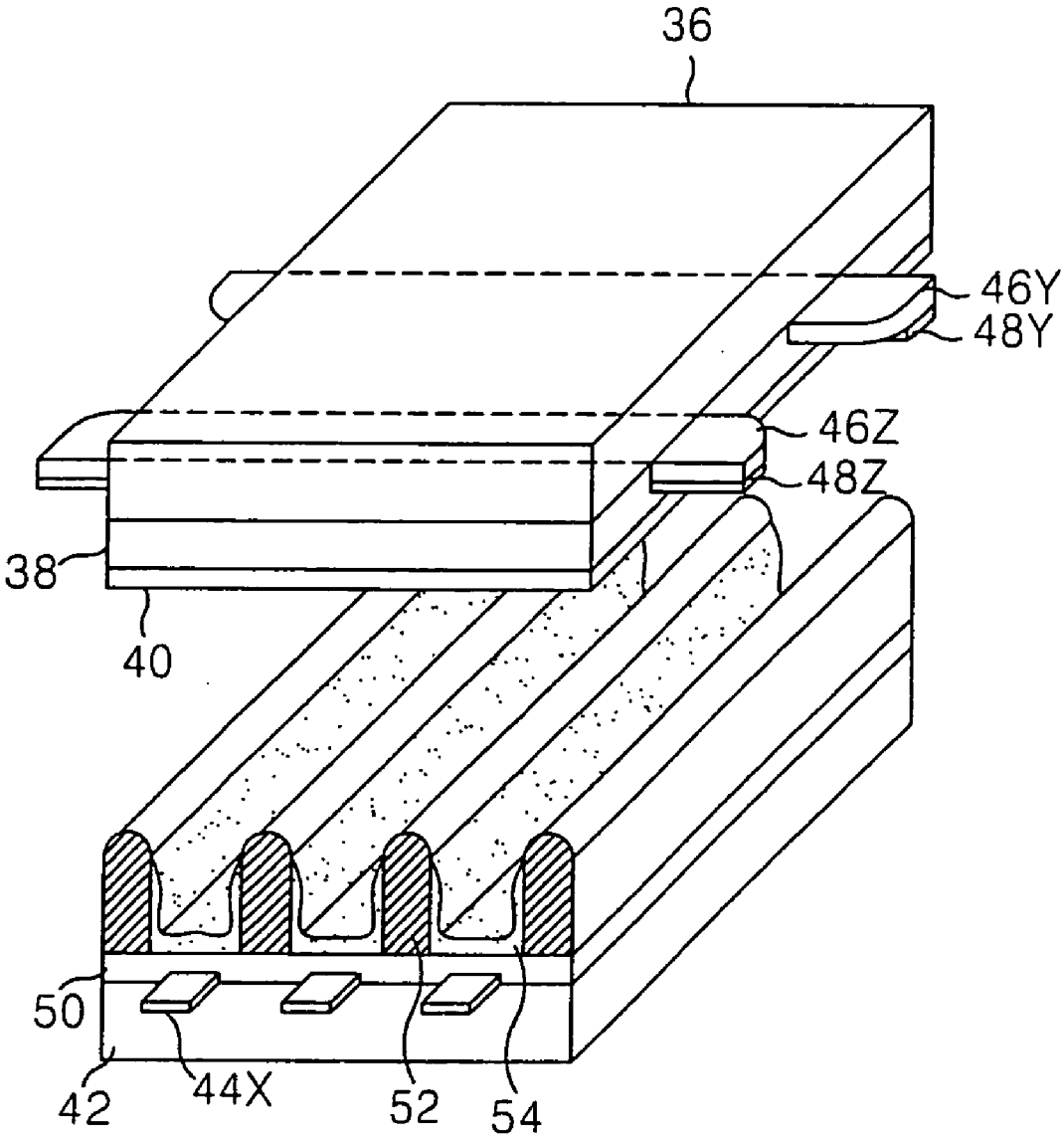
FIG. 4 is a perspective view showing a structure of a plasma display panel according to a first embodiment of the present invention.
Figure 5:
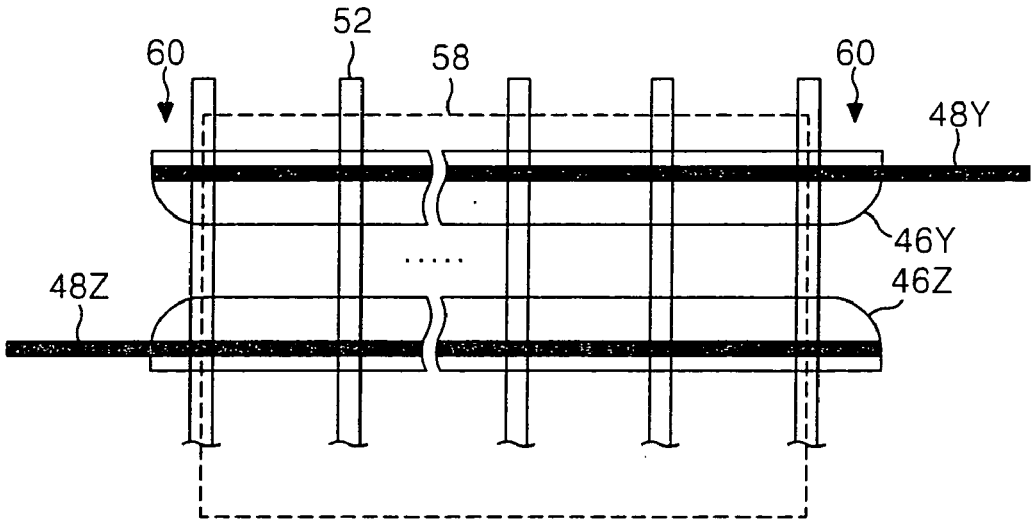
FIG. 5 is a plan view showing an electrode arrangement of the plasma display panel in FIG. 4.

Referring to FIG. 4, there is shown a plasma display panel (PDP) according to a first embodiment of the present invention. The PDP includes a scanning/sustaining electrode 46Y and a common sustaining electrode 46 formed on an upper substrate 36, and an address electrode 44*x* formed on a lower substrate 42. The scanning/sustaining electrode 46Y and a common sustaining electrode 46Z are transparent electrodes made from indium tin oxide (ITO). First and second bus electrodes 48Y and 48Z are formed at the rear sides of the scanning/sustaining electrode 46Y and the common sustaining electrode 46Z. The first and second bus electrodes 48Y and 48Z receive a driving waveform from a driving waveform supply (not shown) and uniformly apply it to the scanning/sustaining electrodes 46Y and the common sustaining electrode 46Z formed from a transparent electrode of ITO. On the upper substrate 36 in which the scanning/sustaining electrode 46Y is formed in parallel to the common sustaining electrode 46Z, an upper dielectric layer 38 and a protective film 40 are disposed. Wall charges generated upon plasma discharge are accumulated in the upper dielectric layer 38. The protective film 40 prevents a damage of the upper dielectric layer 38 caused by the sputtering, generated during the plasma discharge and improves the emission efficiency of secondary electrons. This protective film 40 is usually made from MgO. A lower dielectric layer 50 and barrier ribs 52 are formed on the lower substrate 42 provided with the address electrode 44X, and a fluorescent material 54 is coated on the surfaces of the lower dielectric layer 50 and the barrier ribs 52. The address electrode 44X is formed in a direction crossing the scanning/sustaining electrode 46Y and the common sustaining electrode 46Z. The barrier ribs 52 are formed in parallel to the address electrode 44X to prevent an ultraviolet ray and a visible light generated by the discharge from being leaked to the adjacent discharge cells. The fluorescent material 54 is excited by an ultraviolet ray generated upon plasma discharge to produce a red, green or blue color visible light ray. An active gas for a gas discharge is injected into a discharge space defined between the upper/lower substrate and the barrier rib.

In the above-mentioned PDP according to the first embodiment, a distance between the scanning/sustaining electrode 46Y and the common sustaining electrode 46Z at an effective display part 58 is different from that at a non-display part 60. More specifically, a distance between the scanning/sustaining electrode 46Y and the common sustaining electrode 46Z at the non-display part 60 is larger than that at the effective display part 58. To this end, the scanning/sustaining electrode 46Y at the non-display part 60 has an inner side rounded toward the first bus electrode 48Y. On the other hand, the common sustaining electrode 46Z at the non-display part 60 has an inner side rounded toward the second bus electrode 48Z. Since a distance between the scanning/sustaining electrode 46Y and the common sustaining electrode 46Z at the non-display part 60 is larger as described above, a discharge is not generated at the non-display part 60 by a driving waveform applied from the first and second bus electrodes 48Y and 48Z. In other words, since the effective display part 58 has a small distance between the scanning/sustaining electrode 46Y and the common sustaining electrode 46Z, it generates a discharge. Otherwise, since the non-display part 60 has a large distance between the scanning/sustaining electrode 46Y and the common sustaining electrode 46Z, it does not generate a discharge. Accordingly, it becomes possible to prevent a power waste and a contrast deterioration caused by a discharge at the non-display part 60. Also, it becomes possible to prevent an insulation breakage in the transparent electrodes caused by a concentration of an electric field on the corners of the scanning/sustaining electrode 46Y and the common sustaining electrode 46Z provided at the non-display part 60.

Figure 6:
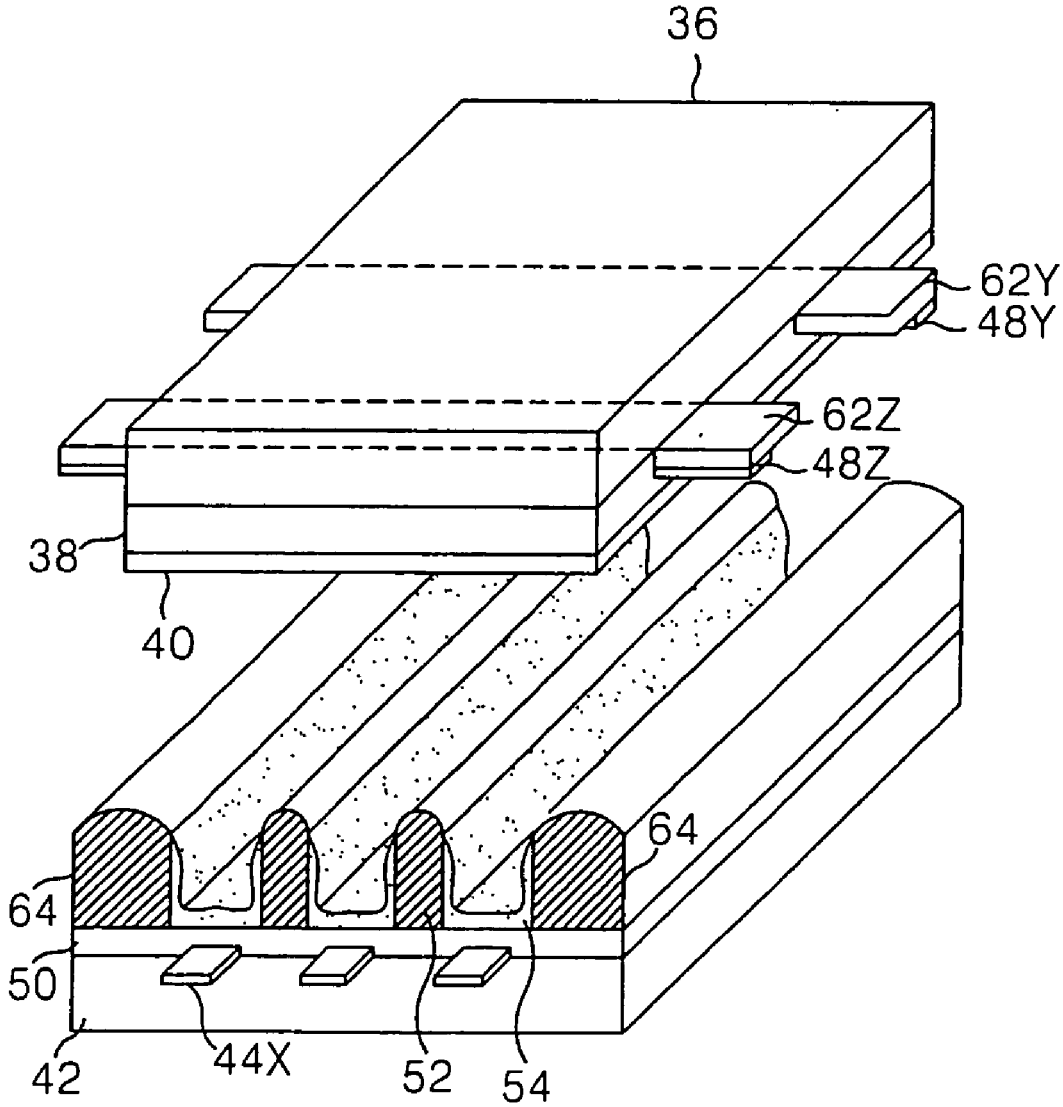
FIG. 6 is a perspective view showing a structure of a plasma display panel according to a second embodiment of the present invention.
Figure 7:
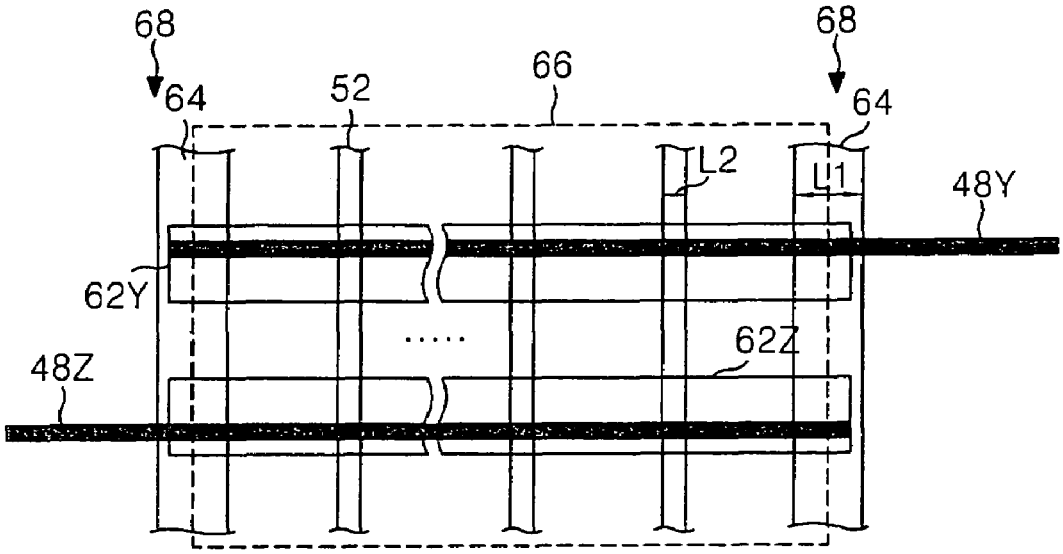
FIG. 7 is a plan view showing barrier ribs of the plasma display panel in FIG. 6.

FIG. 6 and FIG. 7 show a plasma display panel according to a second embodiment of the present invention. In FIG. 6 and FIG. 7, elements having the same construction and function as those in FIG. 4 are given by the same reference numerals, and a detailed explanation as to them will be omitted.

Referring now to FIG. 6 and FIG. 7, in the PDP according to the second embodiment, widths of barrier ribs 52 and 64 at an effective display part 66 are different from those at a non-display part 68. The first barrier rib 52 formed at the effective display part 66 has the same width L2 as that in the prior art, whereas the second barrier rib 64 formed at the non-display part 68 has a wider width L1 than the first barrier rib 52. In this case, the second barrier rib 64 formed at the non-display part 68 has a width L1 larger than lengths of a scanning/sustaining electrode 62Y and a common sustaining electrode 62Z. Thus, discharge spaces of the scanning/sustaining electrode 62Y and the common sustaining electrode 62Z are removed from the non-display part 68, so that a discharge is not generated by a driving waveform applied from each of first and second bus electrodes 48Y and 48Z. Accordingly, it becomes possible to prevent a power waste and a contrast deterioration caused by a discharge at the non-display part 68. Also, it becomes possible to prevent an insulation breakage in the transparent electrodes caused by a concentration of an electric field on the corners of the scanning/sustaining electrode 62Y and the common sustaining electrode 62Z provided at the non-display part 68.

Figure 8:
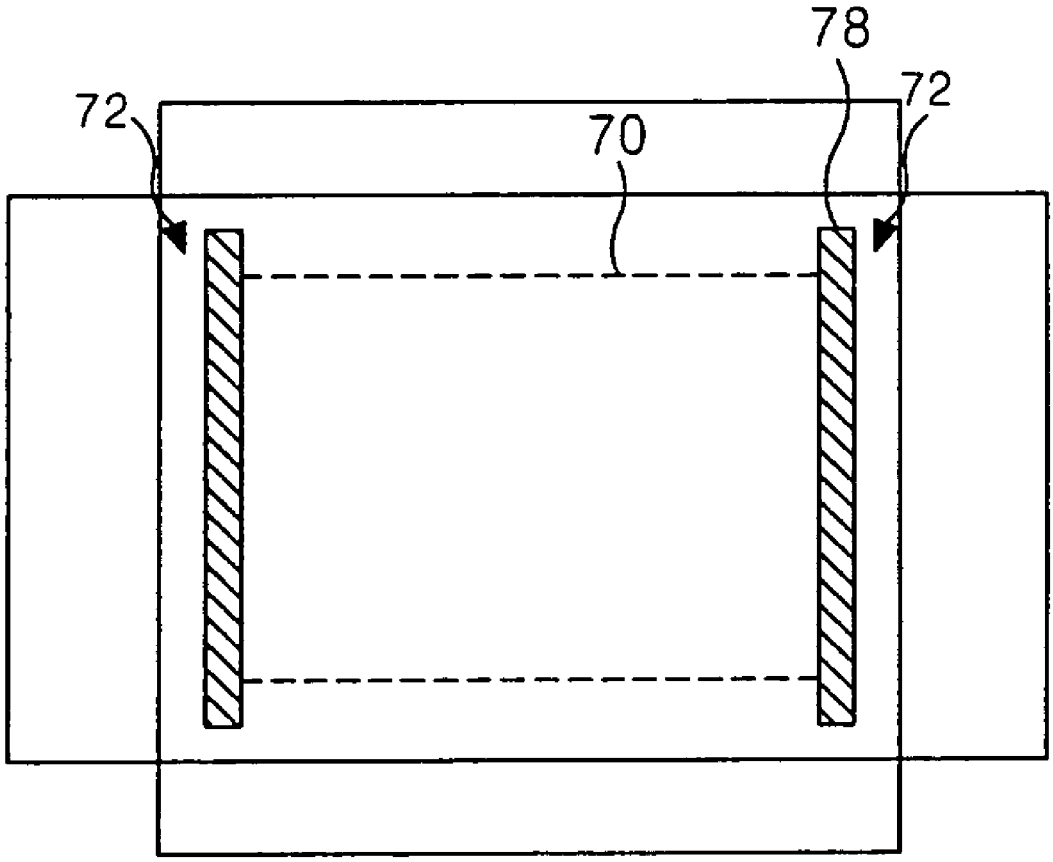
FIG. 8 and FIG. 9 illustrate a structure of a plasma display panel according to a third embodiment of the present invention.
Figure 9:
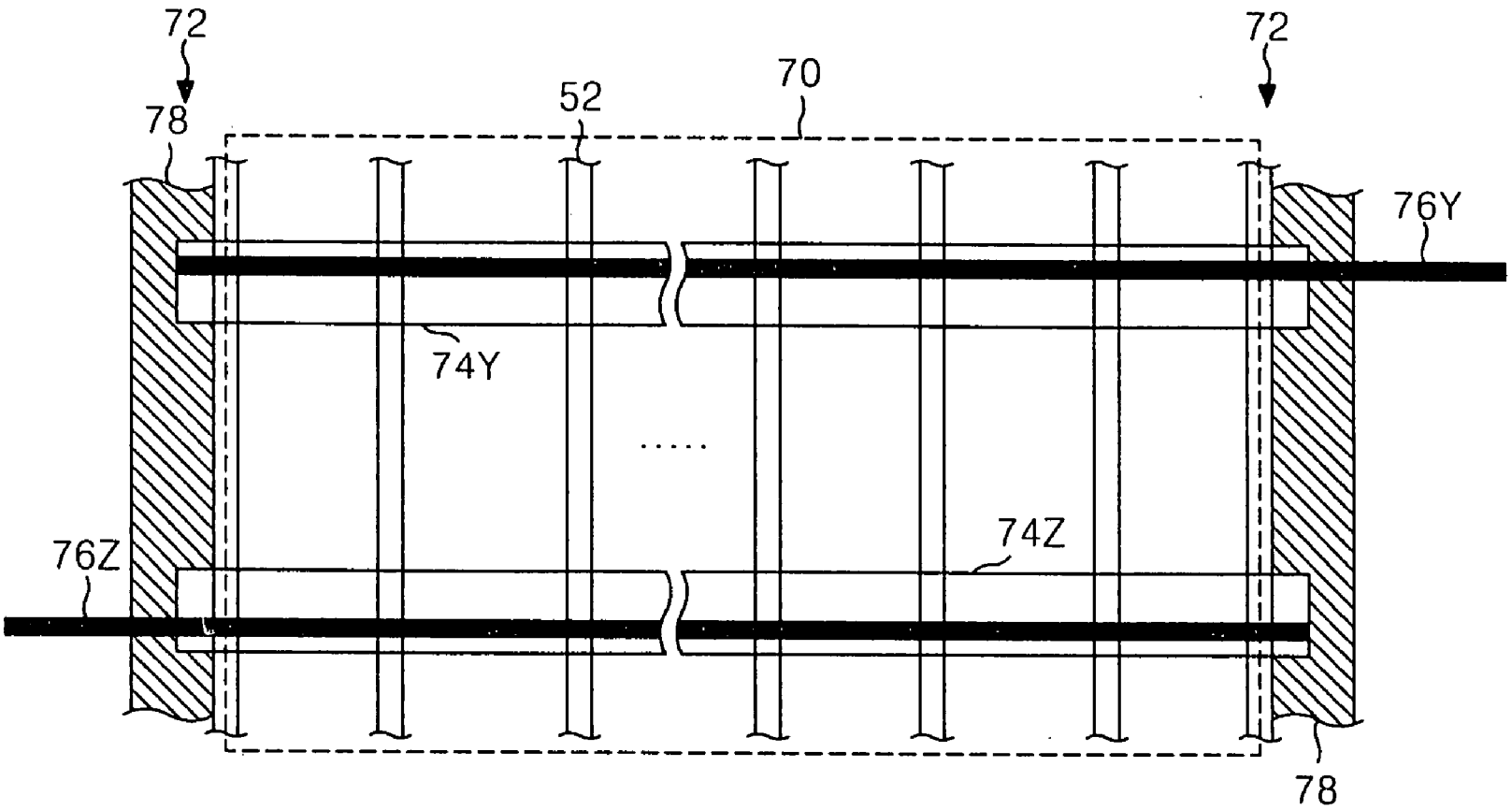

FIG. 8 and FIG. 9 show a plasma display panel according to a third embodiment of the present invention. In FIG. 8 and FIG. 9, elements having the same construction and function as those in FIG. 4 are given by the same reference numerals, and a detailed explanation as to them will be omitted.

Figure 10:
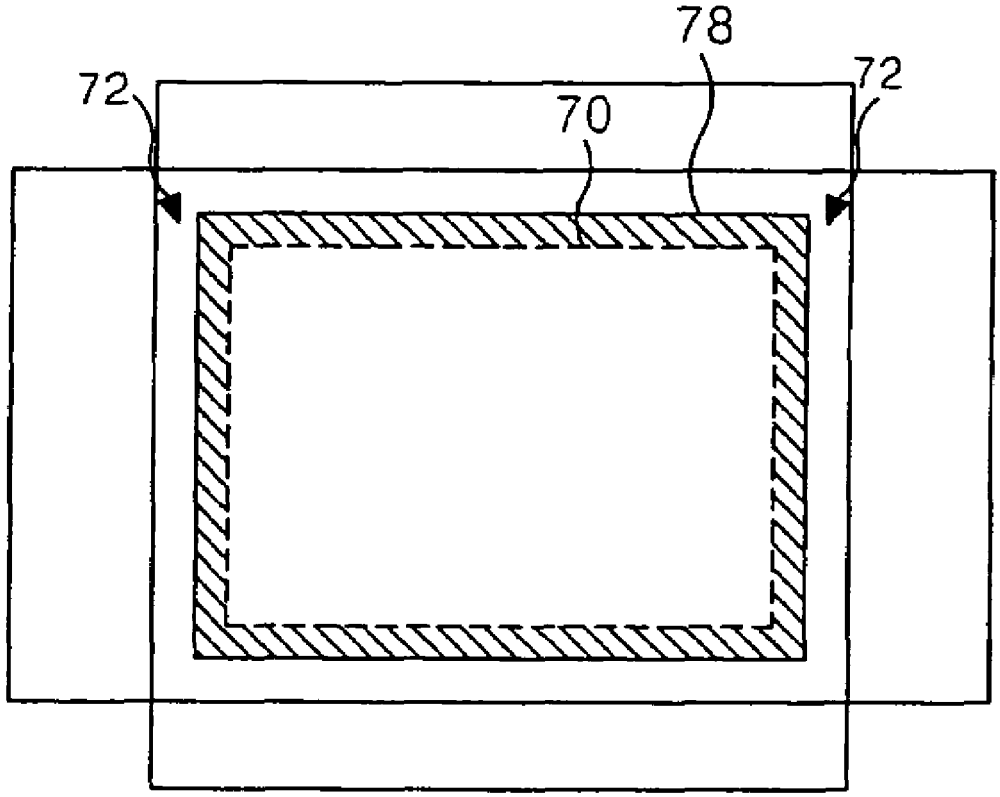
FIG. 10 is a plan view showing a black matrix that is additionally installed at the non-display part of the plasma display panel in FIG. 8.

Referring now to FIG. 8 and FIG. 9, in the PDP according to the third embodiment, black matrices 78 are provided at, a non-display part 72. Each black matrix 78 is arranged in parallel to each barrier rib 52 at the non-display part 72 to thereby shut off a light produced by a discharge of a scanning/sustaining electrode 74Y and a common sustaining electrode 74Z provided at the non-display part 72. Thus, the black matrix 78 can prevent a contrast deterioration in the PDP. Alternately, the black matrices 78 may be installed at the non-display part 72 in a direction crossing the barrier ribs 52 at each longitudinal end of the barrier ribs 52 as shown in FIG. 10.

Figure 11:
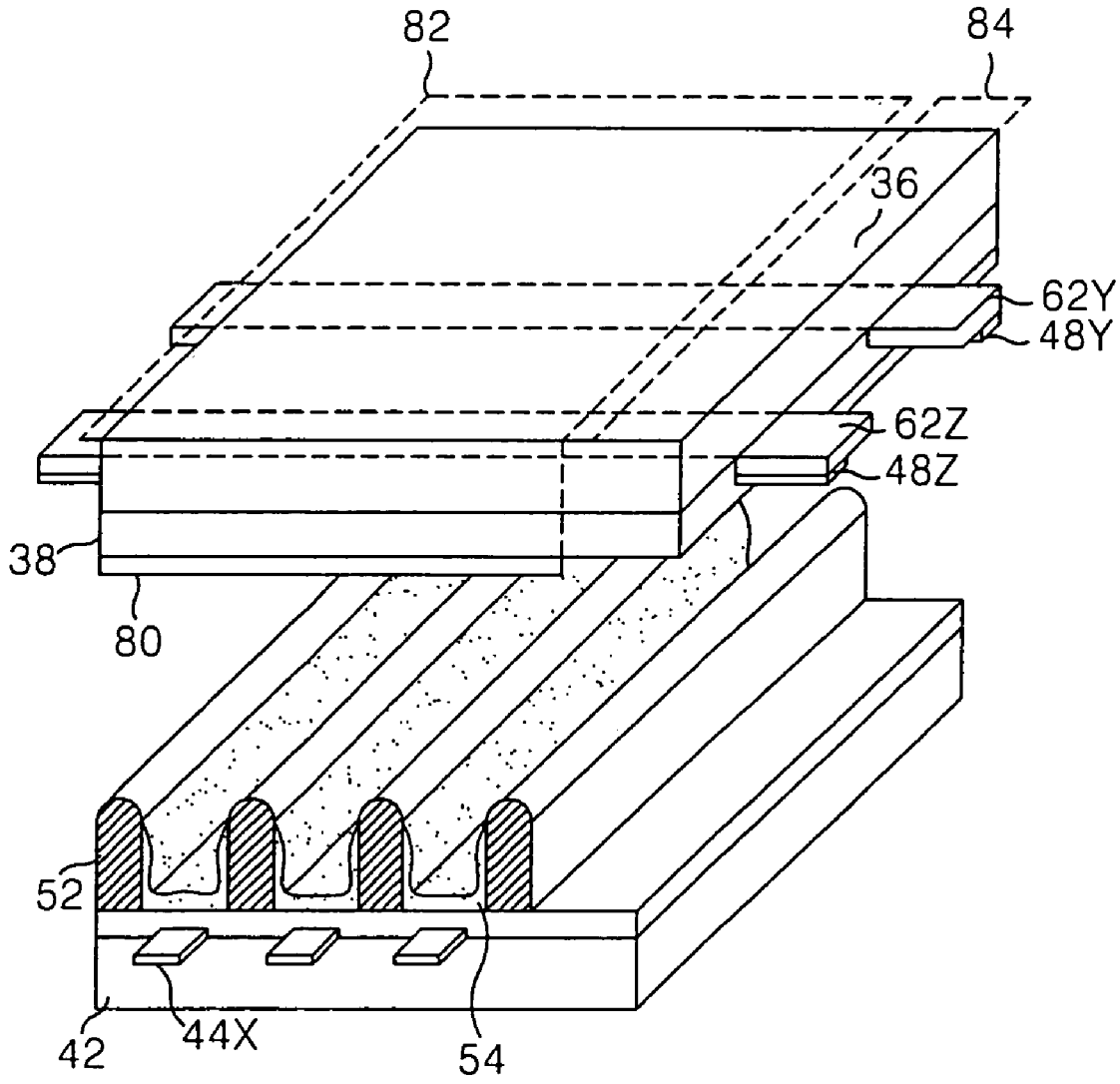
FIG. 11 is a perspective view showing a structure of a plasma display panel according to a fourth embodiment of the present invention.

FIG. 11 shows a plasma display panel according to a fourth embodiment of the present invention. In FIG. 11, elements having the same construction and function as those in FIG. 4 are given by the same reference numerals, and a detailed explanation as to them will be omitted.

Referring to FIG. 11, in the PDP according to the fourth embodiment, a non-display part 84 is not provided with a protective film 80 for preventing a damage of an upper dielectric layer 38 and improving an emission efficiency of secondary electrons. In other words, the protective film 80 is provided only at an effective display part 82 in which a picture is to be displayed, whereas it is not provided at a non-display part 84 in which a picture is not to be displayed. A discharge is not generated at the non-display part 84 that is not provided with the protective film 80 for improving an emission efficiency of secondary electrons. Accordingly, it becomes possible to prevent a power waste and a contrast deterioration caused by a discharge at the non-display part 84. Also, it becomes possible to prevent an insulation breakage in the transparent electrodes caused by a concentration of an electric field on the corners of the scanning/sustaining electrode 62Y and the common sustaining electrode 62Z provided at the non-display part 84.

Meanwhile, the first to fourth embodiment of the present invention may be implemented on a compatible basis. For instance, a PDP implemented by the third embodiment compatible with the fourth embodiment may be designed. In other words, it is possible to provide a PDP wherein the black matrices 78 are formed at the non-display part like the third embodiment and, at the same time, the protective film 80 is formed only at the effective display part 82 like the fourth embodiment.

As described above, the PDP according to the present invention prevents a discharge from being generated at the non-display part in which a picture is not to be displayed. Accordingly, it becomes possible to prevent a power waste caused by a discharge at the non-display part as well as a contrast deterioration caused by a light produced by a discharge at the non-display part. Also, it becomes possible to prevent an insulation breakage in the scanning/sustaining electrode and the common sustaining electrode generated by a discharge at the non-display part.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel, comprising:

a sustaining electrode pair of a transparent conductive material provided on an upper substrate;

a plurality of barrier ribs formed on a lower substrate in a direction crossing the sustaining electrode pair; and a display region coexisting with a non-display region, wherein a first portion of the plurality of barrier ribs are disposed substantially in the display region except for end portions thereof and a second portion of the barrier ribs are disposed partially in the non-display region along a length thereof, and wherein a width of the first portion of barrier ribs is different than a width of the second portion of barrier ribs.

2. The plasma display panel as claimed in claim 1, wherein the width of the second portion of barrier ribs is larger than the width of the first portion of barrier ribs.

3. The plasma display panel as claimed in claim 1, wherein the width of the second portion of barrier ribs is larger than a width of each end of the sustaining electrode pair overlapping the barrier rib.

4. A plasma display panel, comprising:

a lower substrate; and a plurality of barrier ribs formed on the lower substrate, wherein a first portion of the plurality of barrier ribs are disposed substantially in a display region of the plasma display panel except for end portions thereof and a second portion of the barrier ribs are disposed partially in a non-display region of the plasma display panel along a length thereof, and wherein a width of the first portion of barrier ribs is different than a width of the second portion of barrier ribs.

5. The plasma display panel as claimed in claim 4, wherein the width of the second portion of barrier ribs is larger than the width of the first portion of barrier ribs.

6. The plasma display panel as claimed in claim 4, further comprising:

an upper substrate; and a sustaining electrode pair provided on the upper substrate, wherein the plurality of barrier ribs extend in a direction crossing the sustaining electrode pair.

7. The plasma display panel as claimed in claim 6, wherein the width of the second portion of barrier ribs is larger than a width of each end of the sustaining electrode pair overlapping the barrier ribs.

8. The plasma display panel as claimed in claim 7, wherein the sustaining electrode pair comprise a transparent conductive material.

* * * * *